US005882069A

United States Patent [19]

Gunnett et al.

[11] Patent Number: 5,882,069

[45] Date of Patent: Mar. 16, 1999

[54] MULTI-FUNCTIONAL BENCH SEAT

[75] Inventors: David Gunnett, Kalamazoo, Mich.; Bryan M. Fox, Frankfort, Ill.; Dmitry Azrikan, Kalamazoo; Roman J. Rabiej, Mattawan, both of Mich.

[73] Assignee: The Board of Trustees of Western Michigan University, Kalamazoo, Mich.

[21] Appl. No.: 24,396

[22] Filed: Feb. 17, 1998

[51] Int. Cl.[6] ..... A47B 85/04

[52] U.S. Cl. ..... 297/125; 297/283.3; 297/257; 297/188.04; 297/354.11

[58] Field of Search ..... 297/331, 335, 297/92, 125, 124, 188.04, 283.1, 283.3, 376, 248, 249, 1–3, 354.11, 257

[56] References Cited

U.S. PATENT DOCUMENTS 427,359 5/1890 Popenhagen .
772,742 10/1904 O'Leary .
1,158,612 11/1915 Wiesenfeld .
1,188,293 6/1916 Macon .
2,494,900 1/1950 Rosenbaum .
3,990,741 11/1976 Snyder et al. .
5,320,411 6/1994 Sera .
5,531,506 7/1996 Scott .
5,609,391 3/1997 Watts et al. .

FOREIGN PATENT DOCUMENTS 25054 11/1904 United Kingdom .

*Primary Examiner*—Milton Nelson, Jr.
*Attorney, Agent, or Firm*—Flynn, Thiel, Boutell & Tanis, P.C.

[57] ABSTRACT

A multi-functional bench seat. The bench seat has a base to which one or more seat sections are attached. Each seat section has a complementary support arm also attached to the base. A back section is attached to each support arm. Both the seat section and support arm are capable of being rotated relative to the base. The back section is capable of being rotated relative to the seat support arm. Consequently, the bench seat may be positioned in a number of different positions to serve as either a seat or a support table.

19 Claims, 10 Drawing Sheets

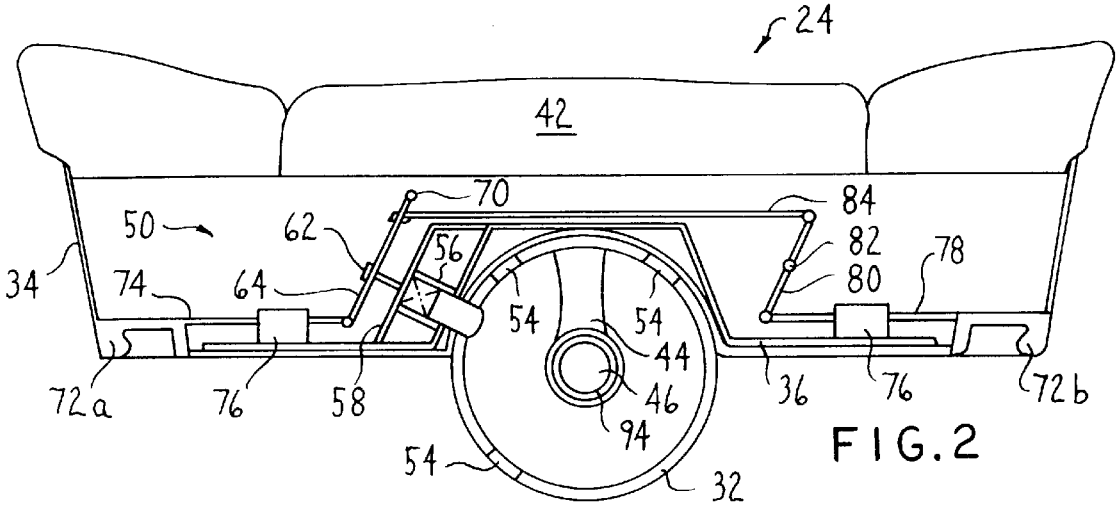
FIG.2
FIG.3
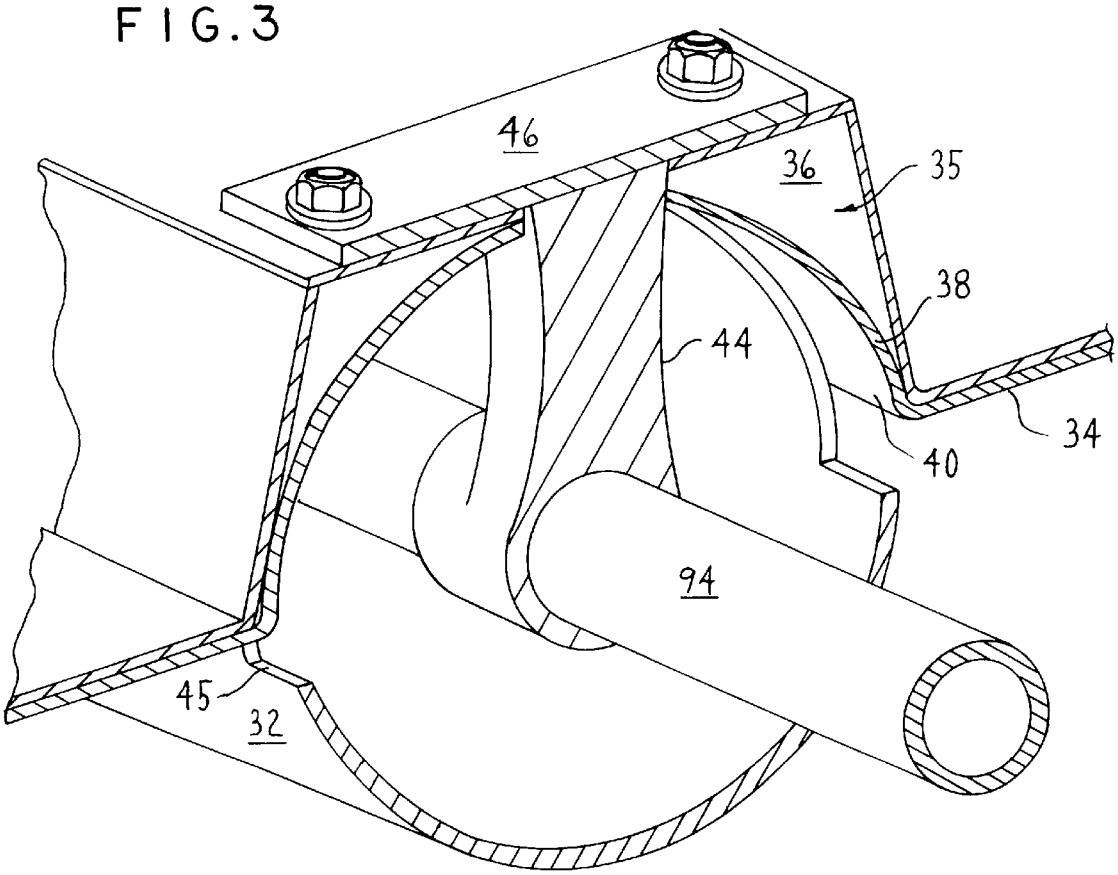

MULTI-FUNCTIONAL BENCH SEAT

FIELD OF THE INVENTION

This invention relates generally to bench seats typically used in public places and, more particularly, to bench seats that can be configured for different functions.

BACKGROUND OF THE INVENTION

Bench seats are commonly found in public places such as atriums, the waiting spaces of airports and train stations and in some food service establishments. A bench seat with individual chair units typically includes a line of individual seat sections. Typically one person sits on each seat section. Associated with each seat section is a back section, the back section provides back support for the individual sitting in the chair unit. While these bench seats are useful for providing individuals places to sit, they are lack other functionality. If a person is sitting next to an empty chair unit, he/she may try using the empty seat section as a support surface. There are typically two problems with this. First, the seat section is typically not horizontally aligned. This makes it difficult to put certain objects on the seat section without running risk of having those objects fall to the floor. Secondly, the vacant seat section is below the natural "lap height". Consequently, the person putting things on and lifting things from the seat section typically has to engage in slightly unusual and ergonomically discomforting body motions.

There have been some bench seats, typically those used in commuter rail cars, that allow the orientation of their back sections to be reversed. This does allow individuals to control the direction they face when seated. However, these seats do nothing to enhance the utility of any adjacent empty seat section as a support surface.

SUMMARY OF THE INVENTION

This invention relates generally to new and useful bench seating system that allows an individual to employ an empty chair unit as a support surface. The bench seating system of this invention is constructed to have seat sections that are attached to a common base. The seat sections are pivotally attached to the base so that they can rotate through a select arc around the base. Integral with each seat section is a back section. Each back section is attached to the base by a support arm. The support arm is pivotally attached to the base and the back section is attached to the support arm. The back section, in addition to having a cushioned front surface that functions as the surface upon a person rests her back, has an opposed rear surface that serves as a table top.

An individual chair unit of the bench seat of this invention can be arranged in a number of positions for different uses. When use of the unit as a seat is desired, the back section is oriented so that it is approximately perpendicular to the approximately horizontal orientation of the seat section. If it is desirable to reverse the orientation of the direction in which the individual is sitting, the support arm is pivoted around the base and the back section is rotated around the support arm. This rearrangement reverses the orientation of the chair unit formed by the seat section and back section. Alternatively, after the support arm is pivoted, the back section may only be rotated so that its rear surface is in an upwardly facing, horizontal orientation. When the back section is so positioned, it serves as a table top that can be used by the individual sitting in the adjacent chair unit.

Also, the seat section and back section may simultaneously be placed in vertical orientations. In fixed versions of the bench seat of this invention, this makes it possible to easily clean under the bench unit, or to provide more standing area in a crowded environment. In portable and moveable versions of the bench seat of this invention, the vertical positioning of the seat and back sections reduces the horizontal profile of the bench seat to allow a number of the bench seats to be stacked together in a relatively small area.

BRIEF DESCRIPTION OF THE DRAWINGS

This invention is pointed out with particularity in the claims. The above and further features of this invention may be better understood by reference to the following description taken in conjunction with the accompanying drawings, in which:

FIG. 2 is a cross-sectional view of illustrating the components of the base and seat section of this invention;

FIG. 3 is a perspective cross-section view illustrating how the seat is secured to the base;

DETAILED DESCRIPTION

Figure 1:
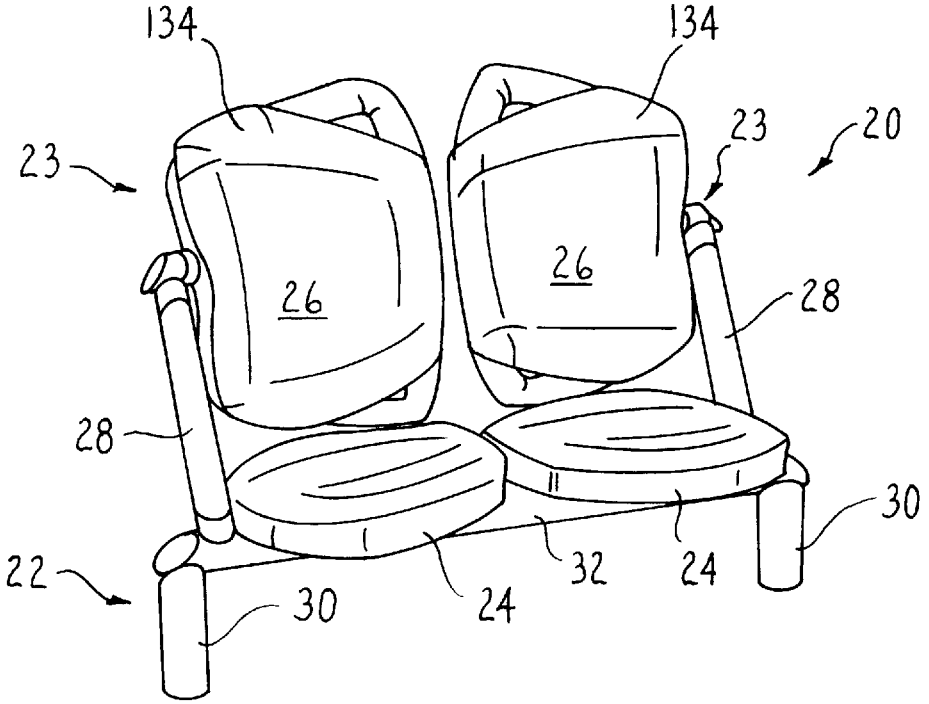
FIG. 1 is a front perspective view of a bench seat of this invention.

FIG. 1 depicts a two-chair unit bench seat 20 of this invention. The bench seat includes a base 22 to which two chair units 23 are mounted. Each chair unit 23 includes a seat section 24 and a back section 26. The seat section 24 is rotatably attached to the base 22 to rotate through an arc of approximately 180°. The back section 26 is connected to the base 22 by a support arm 28. The support arm 28 is pivotally attached the base 22 and the back section is pivotally attached to the support arm.

As seen from FIGS. 1 and 2, in the depicted version of the invention the base 22 is formed out of two upwardly extending, spaced-apart cylindrical posts 30. A cylindrical cross beam 32 extends between posts 30. A first end section 94 of a U-beam 88 (FIG. 5) extends coaxially through cross beam 32 for purposes that will be explained hereinafter.

The seat section 24 includes a seat pan 34 made of plastic or like rigid material as now described by reference to FIGS. 2 and 3. More particularly, the bottom surface of the seat pan 34 is formed to define an upwardly extending groove 40. A weldment 36 is secured to an inner surface of the bottom of the seat pan 34. The weldment 36 extends over the portion of the seat pan 34 that defines groove 34. Weldment 36 provides structural support for the seat pan 34 as well as the components located therein that are described hereinafter. The seat pan 34 is seated over cross beam 32 so that the cross beam is seated in groove 40. A cushion 42 is attached to the normally upwardly oriented portion of the seat pan 34 to serve as the surface upon which an individual using the chair unit 24 sits.

The seat section 24 is rotatably mounted to the base 22 by two trunnions 44, one shown in detail in FIG. 3. Each trunnion 44 extends from a base plate 46 that is secured to the weldment 36 (fastening elements not identified.) The trunnion extends through the seat pan 34 into the groove 40. The trunnion 44 extends from the seat pan 34 through an arcuate slot 45 formed in the cross beam 32. The trunnion 44 is formed with a bore 46 that extends axially through the trunnion. The trunnions 44 are mounted to base 22 by fitting the U-beam first end section 94 in bores 46.

Figure 4:
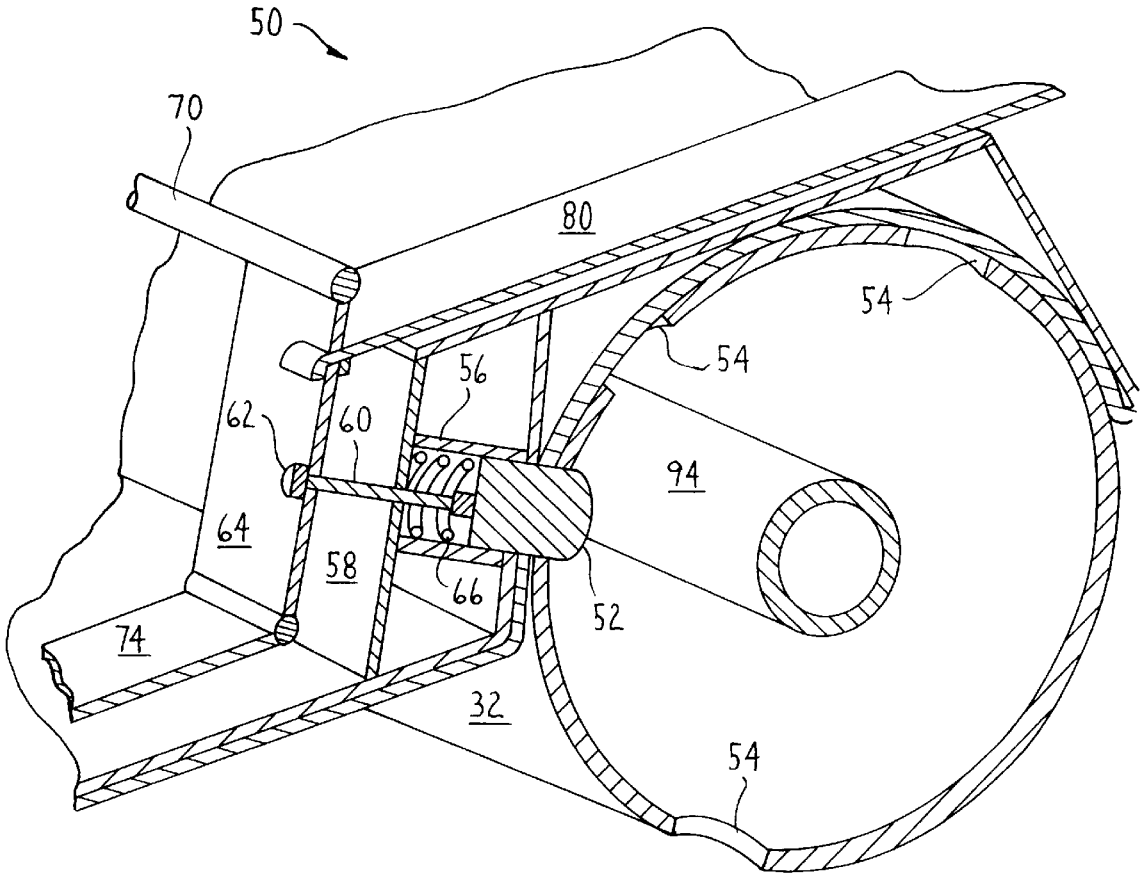
FIG. 4 is a perspective cross sectional view of the lock pin that holds the seat in a selected orientation relative to the base.

A locking mechanism 50 that holds the seat section 24 in a rigid position is now described by reference to FIGS. 2 and 4. Locking mechanism 50 includes a lock pin 52 that is mounted to the seat pan 34 and is selectively seating in holes 54 formed in cross beam 32. The lock pin 52 is housed in a sleeve 56 located inside seat pan 34. More particularly, sleeve 56 extends from an inner face of the bottom wall of the seat pan 34 to a web plate 58 located inside the seat pan 34. The lock pin 52 extends out of the sleeve 56 through coaxial openings formed in the bottom wall of the seat pan 34 and the weldment 36, (openings not identified.) A short cable 60 extends from the end of the lock pin 52 disposed in the sleeve 56 through the sleeve and through the web plate 58. Cable 60 has a headpiece 52 fitted over its free end that abuts a release plate 64, the purpose of which will be discussed hereinafter. A spring 66 disposed in the sleeve 56 between web plate 58 and lock pin 52 urges the lock pin outwardly. The outward movement of lock pin 52 is, however, limited by the abutment of headpiece 62 against release plate 64.

The upper end of the release plate 64 is pivotally attached to the seat pan 34. In the depicted version of the invention, a dowel pin 70 is integrally welded to the top of the release plate 64 and extends horizontally away from the release plate. The free end of dowel pin 70 is rotatably mounted in a block, (not illustrated) integral with the seat pan 34.

The release plate 64 is pivoted, to cause the retraction of lock pin 52, by pulling on one of two handles 72*a* and 72*b* mounted to the seat pan 34. In FIG. 2, handle 72*a* is the handle mounted to the left side undersurface of the seat pan 34; handle 72*b* is handle mounted to the right side undersurface. Handle 72*a* is connected to release plate 64 by a left-side release arm 74. The left side release arm 74 extends from the handle 72*a* to the bottom of the release plate 64, the portion of the release plate spaced from dowel pin 70. The left-side release arm 74 is mounted in a guide sleeve 76 mounted to the inner surface of the weldment 36.

Handle 72*b* is connected to a right-side release arm 78. The right-side release arm 78 is seated in a second guide sleeve 76 mounted to the inner surface of the weldment 36. The end of the right-side release arm 78 distal from handle 72*b* is hingedly secured to a linkage arm 80. A pivot pin 82 that extends horizontally through the center of linkage arm 80 pivotally mounts the arm 80 to the seat pan 34, (the member to which pin 82 connected not shown.) A center release arm 84 is hingedly secured at one end to the end of linkage arm 80 distal from the right side release arm 78. A second end of the center release arm 80 is secured to the release plate 64 below dowel pin 70.

Figure 6:
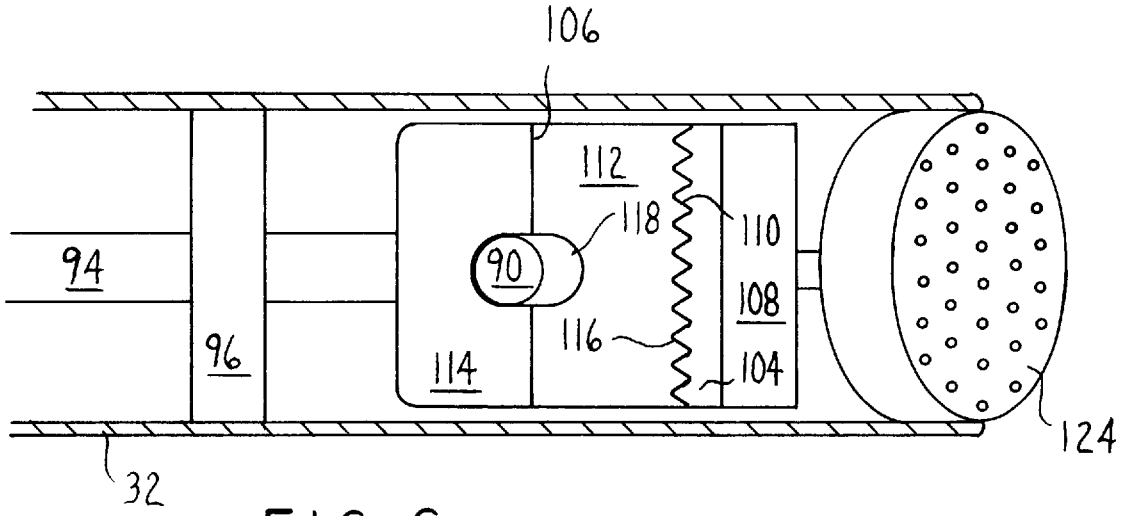
FIG. 6 is a top, partially cut away view illustrating how the support arm is attached to the base.
Figure 5:
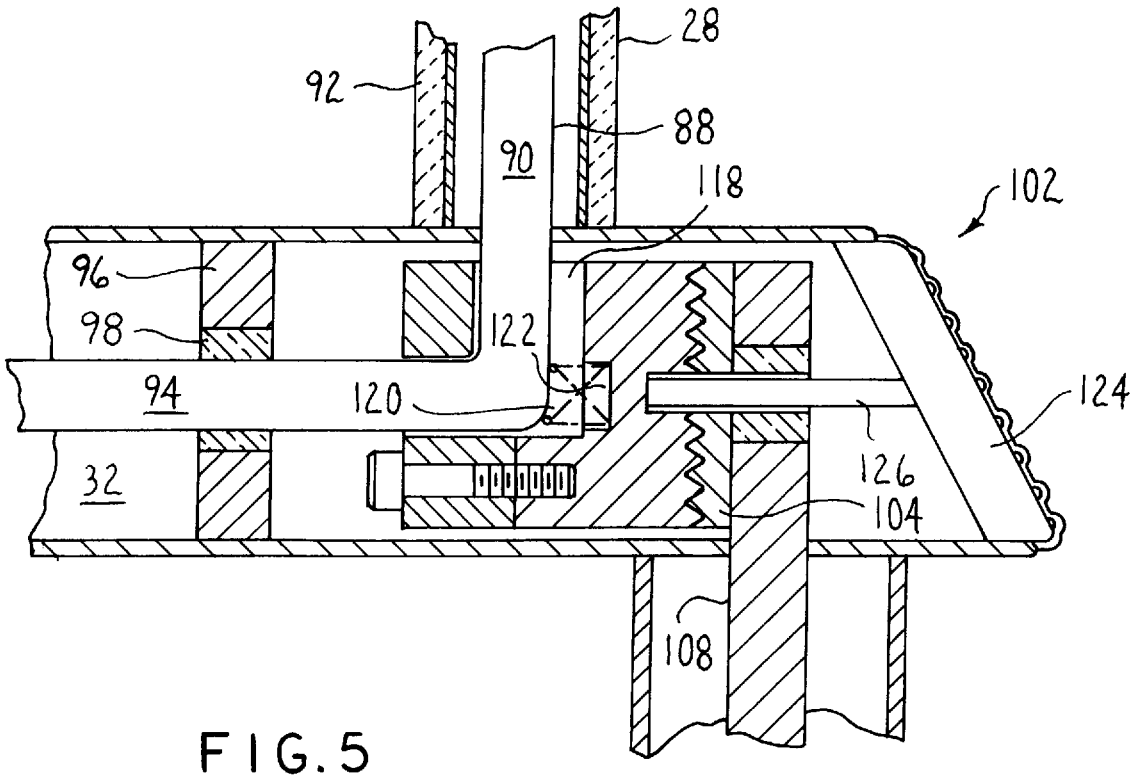
FIG. 5 is a cross sectional view illustrating how the support arm is attached to the base.

FIGS. 5 and 6 illustrate the structure of the support arm 28 of the chair unit 24 and how the support arm is attached to the base 22. Internal to the support arm 28 is the three-sided U-beam 88. The U-beam 88 has a main section 90 that extends between the base 22 and seat section 24. One end of the beam main section 90 extends through a slot, (not identified) in the base cross beam 32. A cylindrical, foam-padded shell 92 extends over the portion of the beam main section 90 that extends from the base 22. Not illustrated, but integral with shell 92, may be an arcuately shaped flange that extends from the end of the shell. This flange covers the arcuate slot in the cross beam 32 through which beam main section 90 pivots. The first end section 94 extends perpendicularly from main section coaxially through the cross beam 32. Beam first end section is rotatably mounted in cross beam 32 by disc-shaped plates 96, one shown. Each plate 96 is provided with a bushing 98 formed of nylon, or other low friction material, which services as the actual component of the plate to which the beam first end section 94 is actually mounted.

A lock assembly 102 sets support arm 28 in a fixed angular position relative to base 22. Lock assembly 102 has a fixed head 104 integral with the base 22 and a complementary rotating head 106 that is attached to the U-beam 88. The fixed head 104 is disc-like in shape and is attached to a fixed stanchion 108 that extends through post 30. The surface of the fixed head 104 against which rotating head 106 seats is formed with teeth 110. Rotating head 106 is formed out of first and second members 112 and 114, respectively, that are secured together. Members 112 and 114 are both generally cylindrical in shape and are dimensioned so as to be rotatable in cross beam 32. First member 112 forms that outer portion of rotating head 106 and is located over the end of the beam main section 90 from which beam first end section 94 extends. The front surface of first member 112, which is the surface of the rotating head 106 that engages fixed head 104, is formed with teeth 116 that are complementary to the teeth 110 of the fixed head. Second member 114 is secured to the rear end of first member and over the portion of beam first end section 94 proximal to the beam main section 90. A bolt, not identified, secures the first and second members 112 and 114, respectively, together.

Collectively, the first and second members 112 and 114, respectively, define an L-shaped channel 118 through which the end of the beam main section 90 and the adjacent portion of the beam first end section 94 extend. The vertically extending portion of channel 118 has an oval profile. This makes it possible to displace rotating head 106 laterally relative to the U-beam 88.

A spring 120 extends between the end of beam main section 90 and the rotating head first member 112. More particularly, it will be noted that the first member 112 is formed with a bore 122 in communication with channel 118 in which one end of spring 120 is seated. Spring 120 biases rotating head 106 outwardly so that the teeth 116 of the rotating head engage the teeth 110 of the fixed head 104. The engagement of teeth 110 and 116 locks outs rotation of the rotating head 106. Since the support arm 28 rotates in unison with the rotating head 106, it is likewise locked out from rotation when teeth 110 and 116 are so engaged.

A button 124 mounted in the open end of the cross beam 32 is depressed to selectively disengage fixed and rotating heads 104 and 106, respectively, from each other. Button 124 is connected to rotating head 106 by a pin 126 that extends through stanchion 108 and fixed head 104. Depression of button 124 causes the rotating head 106 to be moved out of engagement with fixed head 104. Once the head 104 and 106 are so disengaged, support arm 28 can be pivoted around base 22.

Figure 7:
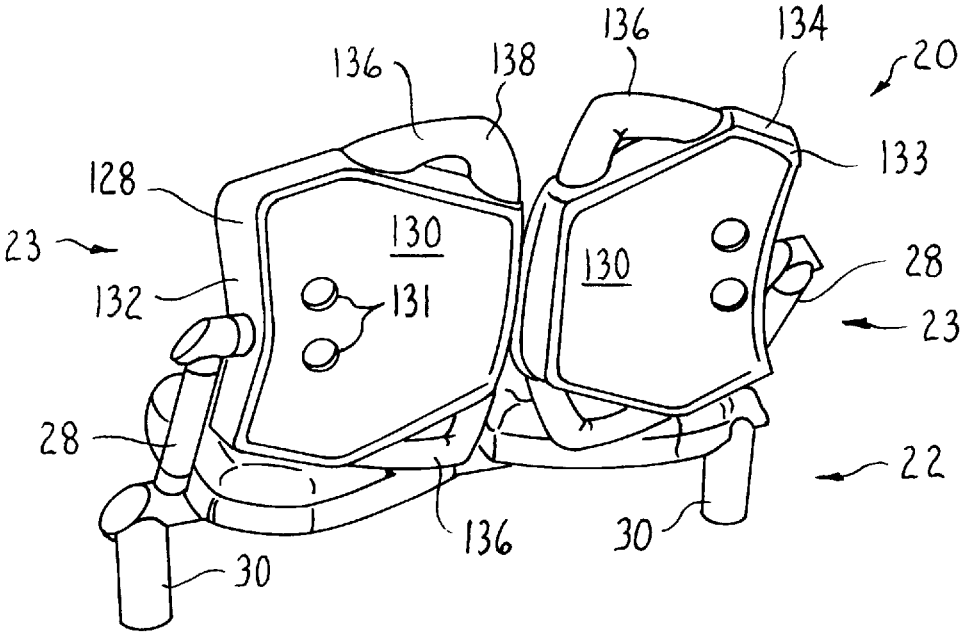
FIG. 7 is a rear perspective view of the bench seat of is invention.

The back section 26 of the chair unit 24 is now described by initial reference to FIGS. 1 and 7. The back section 26 includes a back pan 128 made of plastic or other rigid material which serves as the support frame for the other components of the back section. The back pan 128 has a rear wall 130 from which a set of side walls 132 extend. The side walls 132 collectively form an open front face for the back pan in which a cushion 134 is seated. The rear wall 130 is formed with two circular recesses 131 which are dimensioned to receive drinking cups. It will be further noted that the outer perimeter of the rear wall 130 is formed to have a raised edge 133. The raised edge 133 prevents articles from falling off the rear wall this surface is used as a support surface.

A pair of opposed arms 136 are attached to the back pan 128. The arms 136 are attached to opposed side walls 132, namely, the sidewalls adjacent the side wall to which the support arm 28 is connected. Each arm 136 has two spaced-apart ends that are both attached to the associated side wall 132. In preferred versions of the invention, each arm 136 has a rigid core, (not shown,) that is mechanically attached to the back pan 128; a foam-padded sleeve 138 covers the core. Each arm 136 thus serves two functions: as a hand-hold for a grasp when it is desirable to reposition the back section and as a head/neck rest for a person sitting in the chair unit 23.

Figure 8:
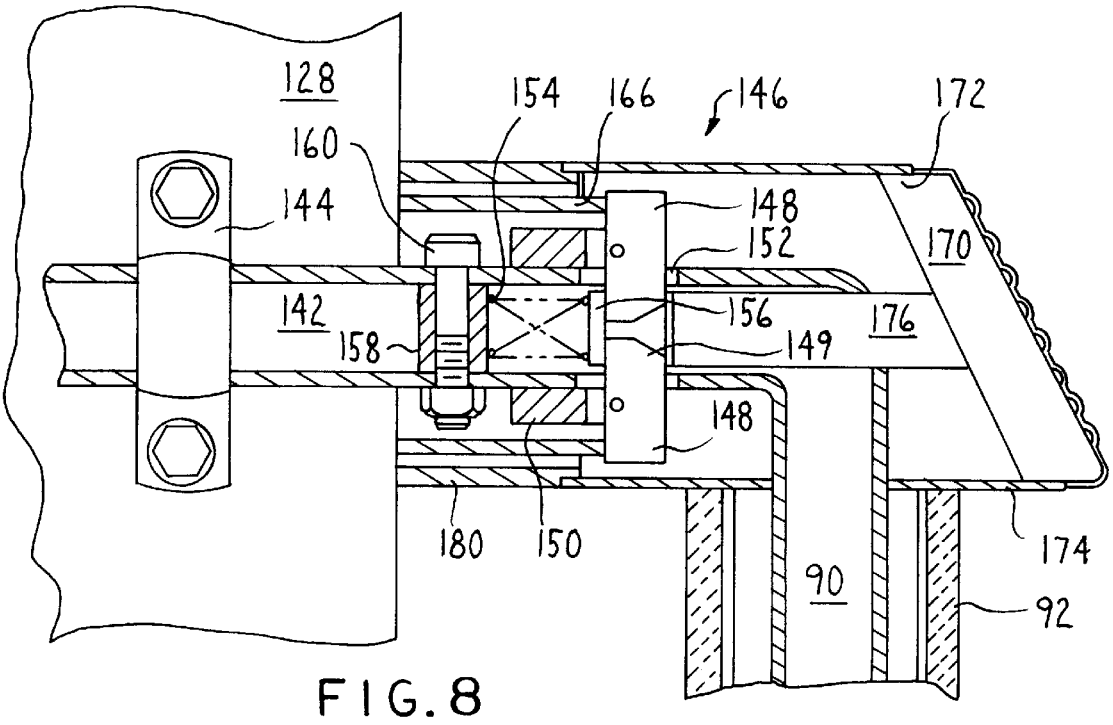
FIG. 8 is a partial cross sectional view illustrating how the back section is held in place relative to the support arm.
Figure 9:
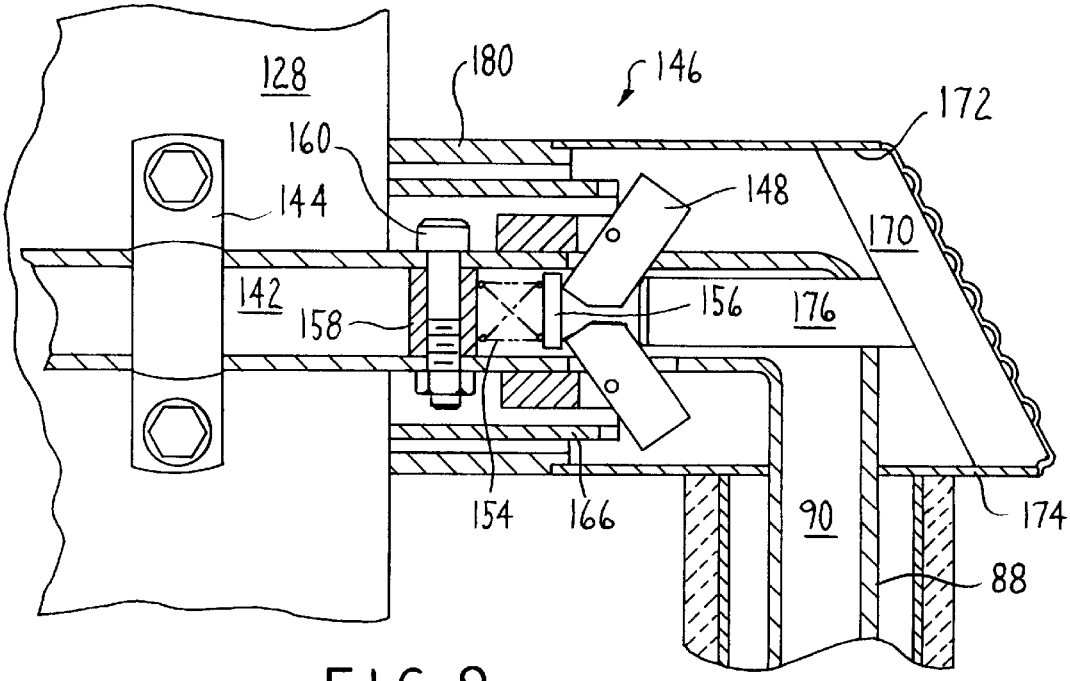
FIG. 9 is a partial cross sectional view illustrating how the back section is disengaged from the support arm so that the back section is able to rotate relative to the support arm.

The back pan 128 is rotatably attached to support arm 28 by a second end section 142 of U-beam 88 as depicted in FIGS. 8 and 9. More particularly, the second end section 142 extends into an opening in the adjacent back pan side wall 132, (opening not identified.) Pillow blocks 144, one shown, that are secured to a wall internal to the back pan 128 rotatably secure the back section 26 to end section 142.

Figure 10:
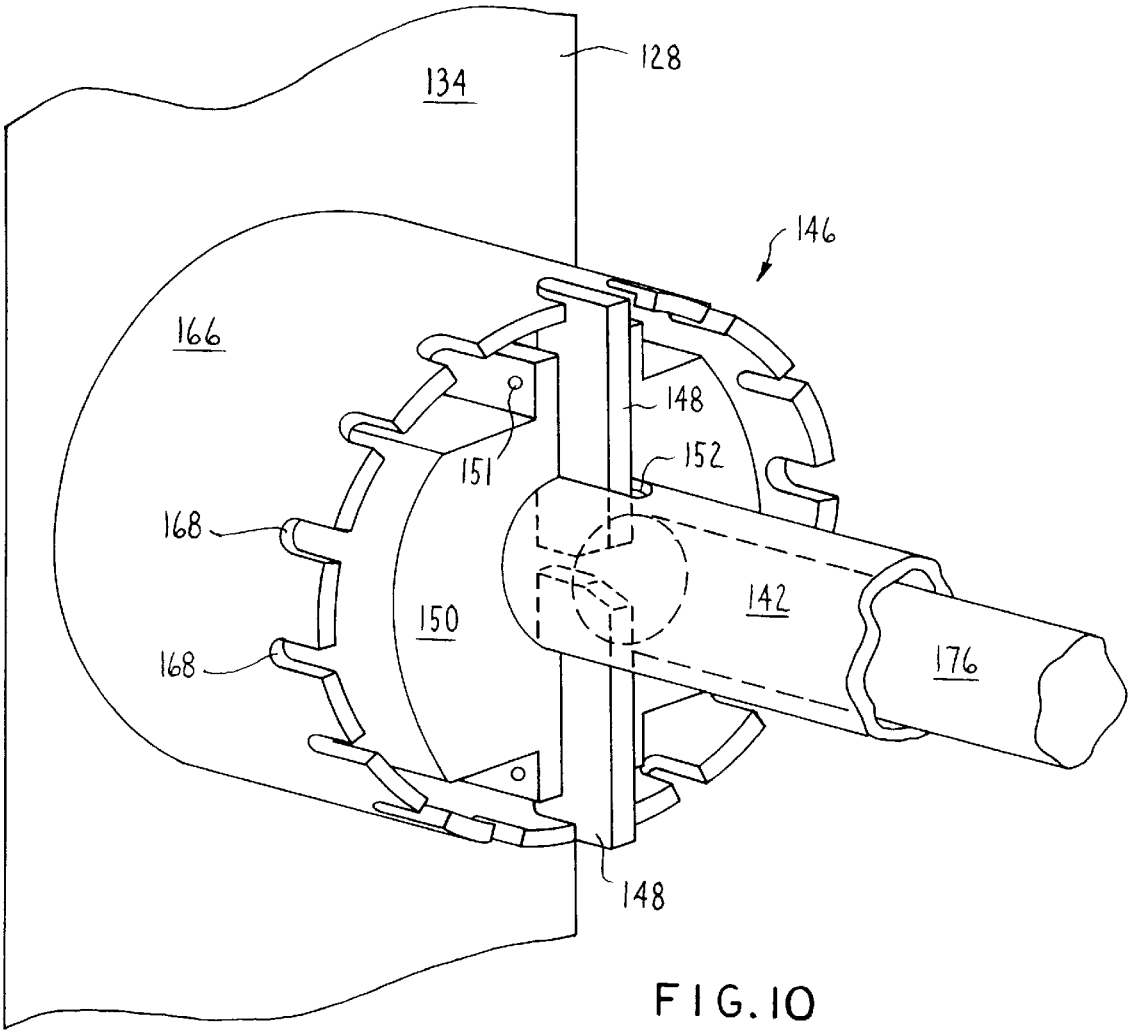
FIG. 10 is a perspective view illustrating the lock assembly that holds the back section in position relative to the support arm.

A lock assembly 146, now described by reference to FIGS. 8, 9 and 10. locks the back section 26 into position relative to the support arm 28. Lock assembly 146 includes a pair of lock arms 148 that are pivotally attached to the portion of the second end section 142 of U-beam 88 adjacent main section 90. The lock arms 148 have a generally cross sectional profile. However, it will be noticed that one end of each arm has a tapered surface 149, the purpose of which will be explained hereinafter. More particularly, lock arms 148 are pivotally secured to a static collar 150 that is fitted around the second end section 142. A pin 151 extending through an opening in the center of the lock arm 148 secures each lock arm to the static collar 150. The end of each lock arm 148 that defines the tapered surface 149 extends through a slot 152 formed in the beam second end section 142.

A spring 154 and a latching disc 156 normally bias the ends of the lock arms 148 that extend into the second end section 142 outwardly. The spring 154 has one end that is seated against a circular shaped stopper 158 that is seated inside the second end section 142 of U-beam 88. A threaded fastener 160, that extends through the second end section 142 and stopper 158, holds the stopper in place. Latching disc 156 is fitted over the second end of spring 154. The force generated by spring 154 causes the latching disc 156 to move against the ends of the lock arms 148 so as to pivot the outer ends of the arms towards the back section 26. The rearward movement of the outer ends of the lock arms 148 is blocked by abutment of the lock arms against the edge of a lock collar 166 described below.

The lock arms 148 are positioned to engage the locking collar 166 which is integral with the back section 28. Specifically, the lock collar 166 is integrally attached to and extends outwardly from the side wall 134 of the back pan 128 into which the U-beam 88 extends. More particularly, the second end section 142 of the U-beam 88 extends axially through the center of lock collar 166. The outer end of lock collar 166 is formed with a number of slots 168. When the lock arms 148 are in their vertical, locked state, each lock arm seats in a separate one of the slots 168.

A push button 170 seated in the support arm 28 is depressed to free the lock arms 148 from their locked state. Push button 170 is mounted in an opening 172 defined by an annular flange 174 formed integrally with shell 98. A rod 176 extends inwardly from push button 170 into the beam second end section 142. Normally, the end of the rod 176 is in close proximity to or barely abuts the adjacent vertical surfaces of the lock arms 148 that extend into the second end section 142. When the button 170 is depressed, rod 176 pushes against the lock arms 148 to cause the outer ends of the lock arms to pivot inwardly. It will be seen from FIG. 9, that tapered surfaces 149 facilitate the rotation of the lock arms 148. This displacement of the lock arms 148 causes their outer ends to rotate away from the lock collar slots 168 in which they are seated. Once the lock arms 148 are so displaced, the back section 26 of the chair unit can be rotated to a new orientation relative to support arm 28.

An outer sleeve 180 also extends outwardly from the side wall of the back pan 128 from which lock collar 166 extends. Outer sleeve 180 has an open end that sits in the complementary open end of shell 98. More particularly, it will be recognized that when the lock assembly 146 is in the unlocked stated, the outer sleeve will rotate relative to shell 98.

Figure 11:
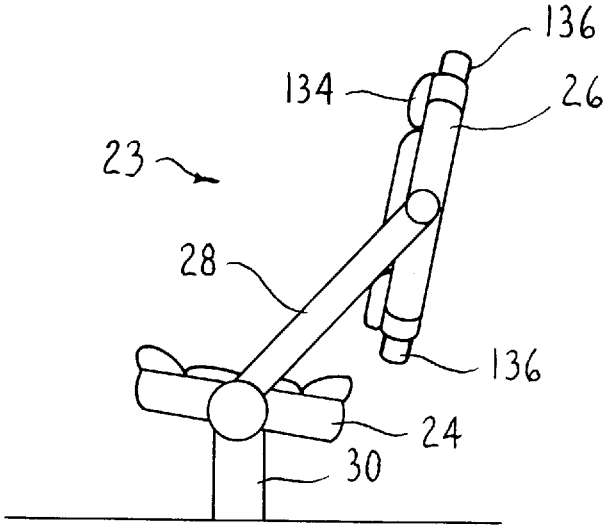
FIG. 11 is a side view illustrating the bench seat of this invention.

The bench seat 20 of this invention can be set for use in a number of different configurations. As seen by FIG. 11, when the chair unit 23 is used as a seat, the seat section 24 is adjusted so that the end adjacent the back section has a slight downward orientation. When the seat section 24 is so positioned, the chair unit 23 provides comfortable support for both the rear and back of the person using it as a seat. As depicted by FIG. 1, the adjacent back sections 26 can be positioned to have the same orientation so that the bench seat provides conventional bench-style seating.

Figure 12:
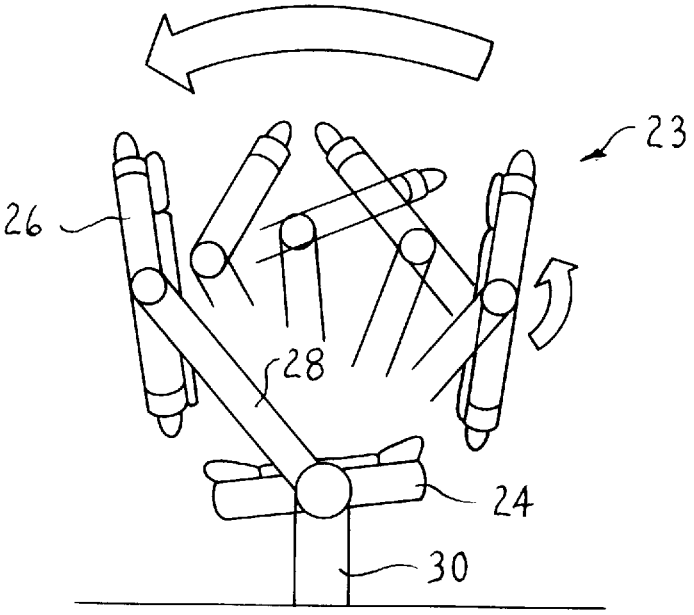
FIG. 12 is a side view illustrating how the orientation of a chair unit of this invention can be selectively reversed.

The orientation of the chair unit 23 may, if desired be changed as represented by FIG. 12. As one step in this process, the seat section is positioned so that the end that was slightly elevated is lowered relative to the opposed end, Then by the rotation of both the back section 26 and support arm 28, the direction in which the back section cushion 134 is oriented is reversed. Once the repositioning of these components is complete, a person can sit in the chair unit and face in the direction opposite the direction in which the set unit was originally oriented. If two persons sitting side-to-side wish to speak with each other, they may wish to place the adjacent chair units 23 in opposite to facilitate eye contact with each other.

Figure 13:
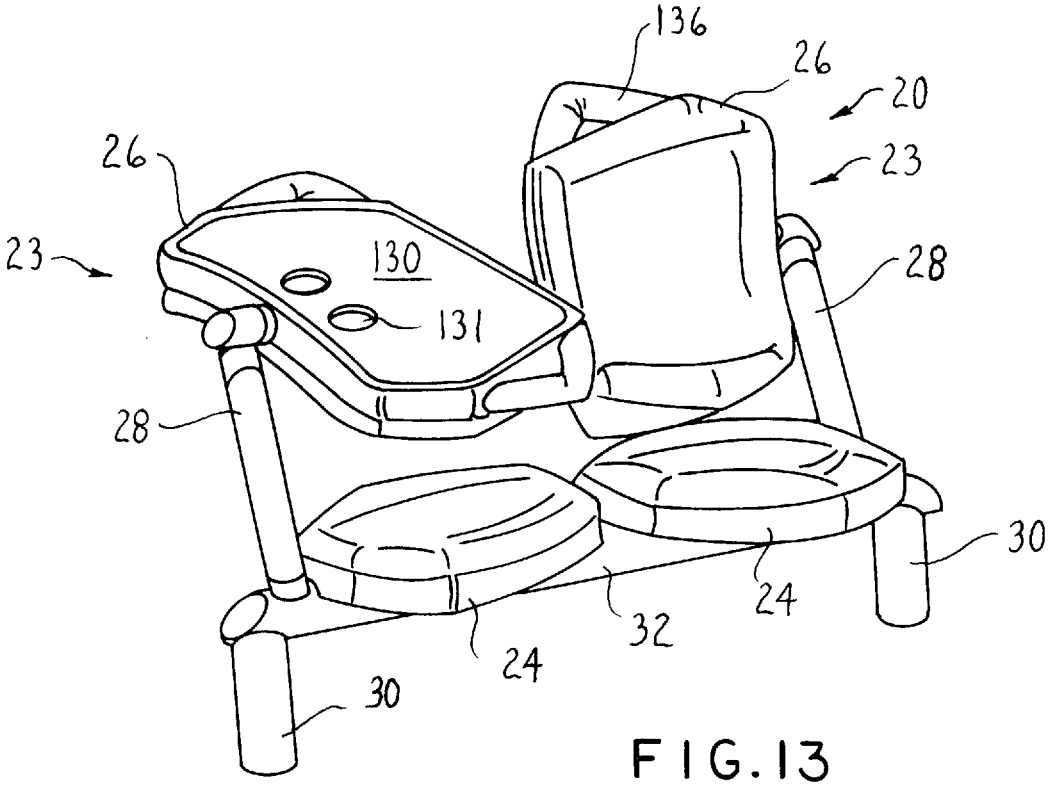
FIG. 13 is a perspective view illustrating how a chair unit of this invention can be reset to function as a table top.
Figure 14:
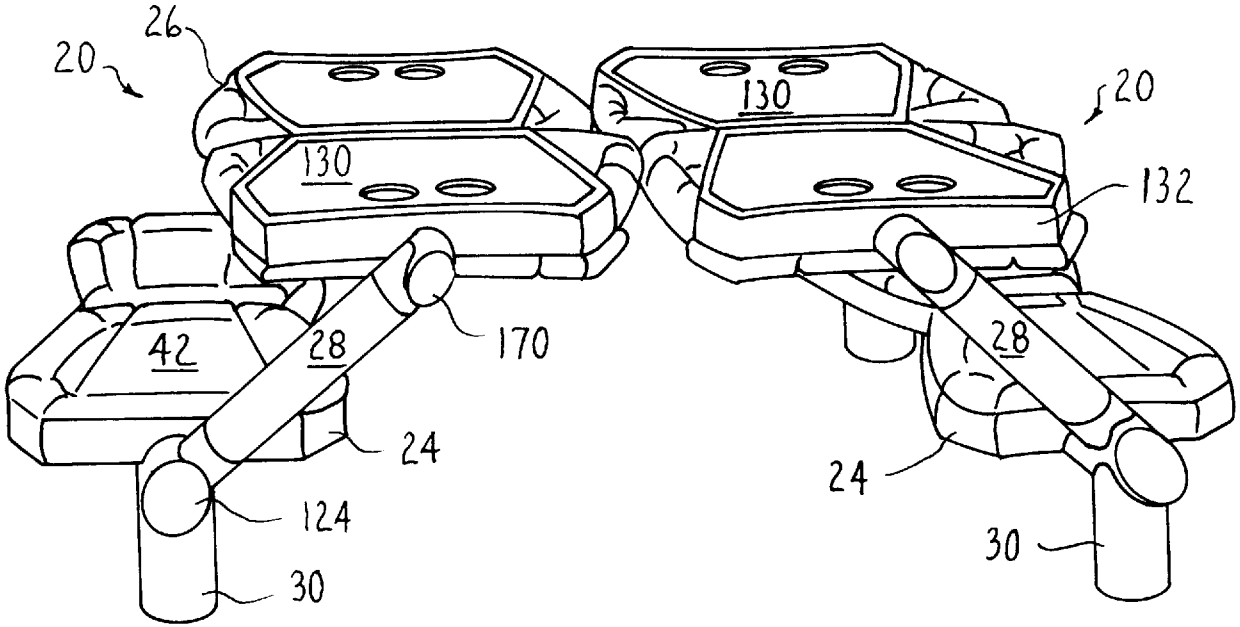
FIG. 14 is a perspective view illustrating how back sections of alternative bench seats of this invention in adjacent rows can be placed together to form a table around which individuals can sit.

Alternatively, if one chair unit 23 is vacant, an individual can position the back section 26 of the vacant chair unit so that the back wall 130 is upwardly and horizontally positioned, as seen by FIG. 13. When this back section 26 is so positioned, it serves as a table top for the person occupying the adjacent chair unit 23. FIG. 14 illustrates an alternative bench seat 20*a* of this invention. Here, the back sections 26*a* have a generally rectangular profile. Here adjacent rows of bench seats 20*a* may be positioned so that when the back sections 26*a* are placed in the horizontal orientation, they are in close proximity or abut each other. Thus, when these bench seats 20*a* are so configured, the back sections 26*a* of the aligned seat sections 24*a* serve as a single table around which individuals can face each other.

Figure 15B:
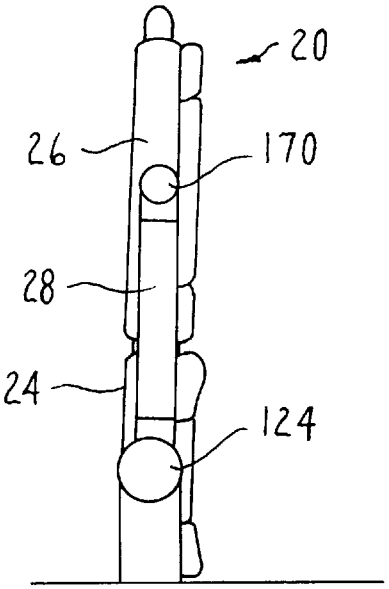
FIGS. 15A and 15B are, respectively front and side views illustrating how the chair units of this bench seat can be folded vertically to reduce the floor area occupied by the bench seat.
Figure 15A:
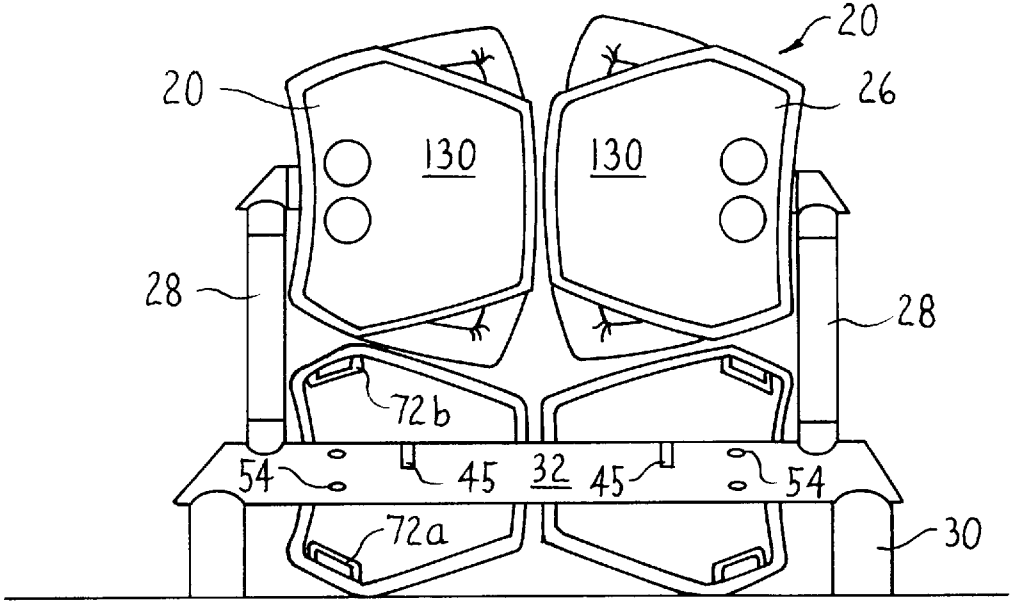

Moreover, in the event use of the bench seat 20 is not required, the seat section 24 and back section 26 may be repositioned to reduce the space the bench seat occupies. As depicted by FIGS. 15A and 15B, this is accomplished by folding seat 26 section, the back section 26 and the support arm 28 so they all have a vertical orientation. Once these components are so positioned, mobile versions of this bench seat 20 can easily stacked. Thus, these bench seats could easily be repositioned in a vehicle in order to increase the available contiguous space for storing cargo. Alternatively, it becomes relatively easy to access the floor underneath the fixed versions of this bench seat for cleaning.

The foregoing description is directed to one embodiment of the bench seat of this invention. It should be recognized that other versions of this invention are possible. For example, there is no requirement that each version of this bench seat only have two chair units 23. In other versions of the invention it may be desirable to provide three or more chair units. Also, the mechanisms employed to lock the seat section 24, the back section 26 and the support arm 28 in place may be different from what has been described.

Furthermore, while the components of the bench seat, the seat section 24, the back section 26 and the support arm 28, are shown as just having two or three positions each, it should be recognized that that is not always the case. The locking assemblies that hold these components in position may allow the positions of these components to be further adjusted. For example, it may be possible to reset the back section 26 and the support arm 28, so that the chair unit 23 to serve as a recliner. Accordingly, it is the object of the appended claims to cover all such modifications and variations that come within the true spirit and scope of this invention.

The embodiments of the invention in which an exclusive property or privilege is claimed are defined as follows:

1. A bench seat assembly, said assembly comprising:

an elongated, horizontally extending base; and a plurality of chair units connected to said base, each said chair unit comprising:

a seat section pivotally connected to said base;

a first locking assembly secured to said seat section for selectively locking said seat section in a selected position relative to said base;

a support arm having a first end and a second end, said first end of said support arm being pivotally connected to said base;

a second locking assembly connected to said support arm for locking said support arm in a selected position relative to said base;

a back section that is rotatably attached to said second end of said support arm, said back section having a first face configured as a seat back and second face opposite said first face configured as a table top; and a third locking assembly connected to said support arm and said back section to lock said back section into selected positions relative to said support arm, said third locking assembly being configured to lock said back section into a first position wherein said back section first face has a first substantially vertical orientation for supporting a back of an individual, a second position wherein said back section first face has a second substantially vertical orientation for supporting a back of an individual, the second orientation being opposite the first orientations, and a third position wherein said back section second face has a horizontal, upwardly directed orientation so that said back section second face functions as a table top.

2. The bench seat assembly of claim 1, wherein said second face of said back section is formed with at least one recessed section.

3. The bench seat assembly of claim 1, wherein:

said support arm includes a U-beam with a main section that extends away from said base, a first end section that extends from said main section through said base and a second end section that extends from said main section and is parallel to said first end section;

said first end section of said U-beam is rotatably mounted to said base and said second locking assembly is configured to selectively inhibit the rotation of said first end section; and said back section is rotatably mounted to said second end section of said U-beam and said third locking assembly is configured to selectively inhibit rotation of said back section.

4. The bench seat assembly of claim 3, wherein said seat section is pivotally mounted to said first end section of said U-beam.

5. The bench seat assembly of claim 1, wherein:

said base includes a horizontally oriented cross beam;

said seat sections are connected to said cross beam; and said support arms are connected to said cross beam.

6. The bench seat assembly of claim 5, wherein:

said support arm includes a U-beam that has a first end section that extends through said cross beam and a second end section parallel to said first end section to which said back section is pivotally mounted.

7. The bench seat assembly of claim 5, wherein:

said support arm includes a beam that extends from said cross beam to said back section and a shell that encases said beam; and each said third locking assembly includes a release button for switching said third locking assembly from a locked state to an unlocked state and said release button is seated in an opening formed in said shell of said support arm to which said third locking assembly is connected.

8. The bench seat assembly of claim 5, wherein:

said cross beam has opposed ends; two said chair units are mounted to said cross beam; and said second locking assemblies each include a first release button for switching said second locking assembly from a locked state to an unlocked state, wherein said first release buttons are mounted in opposed openings formed in said opposed ends of said cross beam.

9. The bench seat assembly of claim 8, wherein:

said support arm includes a beam that extends from said cross beam to said back section and a shell that encases said beam; and each said third locking assembly includes a second release button for switching said third locking assembly from a locked state to an unlocked state and said second release button is seated in an opening formed in said shell of said support arm to which said third locking assembly is connected.

10. A bench seat assembly comprising:

a base unit having a pair of vertically oriented, spaced apart support posts and a cross beam that extends between said support posts; and a plurality of chair units, each said chair unit having:

a seat section fitted over said cross beam so as to rotate around said cross beam;

a support arm having: a first end section disposed in said cross beam, wherein said seat section is pivotally mounted to said first end section; a main section integral with said first end section that extends away from said cross beam wherein said main section pivots relative to said cross beam; and a second end section integral with and that extends away from said main section;

a first locking assembly connected between said seat section and said cross beam for locking said seat section in a fixed position relative to said cross beam;

a second locking assembly connected between said cross beam and said support arm for locking said support arm in a fixed position relative to said cross beam;

a back section that is rotatably attached to said second end section of said support arm, said back section having a first face configured as a seat back and second face opposite said first face configured as a table top; and a third locking assembly connected to said support arm and said back section to lock said back section into selected positions relative to said support arm, said third locking assembly being configured to lock said back section into a first position wherein said back section first face has a first substantially vertical orientation for supporting a back of an individual, a second position wherein said back section first face has a second, substantially vertical orientation for supporting a back of an individual, the second orientation being opposite the first orientation, and a third position wherein said back section second face has a horizontal, upwardly directed orientation so that said back section second face functions as a table top.

11. The bench seat assembly of claim 10, wherein each said back section has opposed side walls that are parallel to said support arm second end section to which said back section is mounted and an arm is mounted to each said side wall, each said back section arm having two spaced apart ends that are secured to said side wall with which said back section arm is associated.

12. The bench seat assembly of claim 10, wherein: each said support arm includes a shell that encases said main section of said support arm; and each said third locking assembly includes a release button for switching said third locking assembly from a locked state to an unlocked state and said release button is seated in an opening formed in said shell of said support arm to which said third locking assembly is connected.

13. The bench seat assembly of claim 10, wherein each said second locking assembly includes a first release button for switching said second locking assembly from a locked state to an unlocked state, wherein said first release buttons are positioned in openings formed in said cross beam.

14. A bench seat assembly comprising:

two base units located parallel and spaced apart from each other;

a plurality of seat units, at least two said seat units being attached to each said base unit, wherein said seat units are arranged so that one said seat unit attached to a first said base unit is aligned with one said seat unit attached to a second said base unit; and a plurality of back sections, each said back section being associated with a separate one of said seat units and each said back section being attached to said base unit to which said associated seat unit is attached by a support arm and each said back section having a front face that serves as a back support and a rear face opposite said front face that functions as a table top, wherein each said support arm is rotatably attached to said associated base unit and said back section is rotatably attached to said support arm so that said back section can be moved from a first position wherein said back section front face serves as a back support for said associated seat unit and a second position wherein said back section rear face serves as a table top and wherein said back sections associated with said aligned seat units can be positioned adjacent each other to function as a single table top.

15. The bench seat assembly of claim 14, wherein each said back section includes a back locking assembly, each said back locking assembly configured to lock said back section into fixed orientations relative to said support arm to which said back section is attached so that said back section can be locked into the first position or the second position.

16. The bench seat assembly of claim 15, wherein said back locking assembly is further configured to lock said back section in a third position in which said back section serves as a back support for said associated seat unit and said back section has an orientation opposite the orientation of said back section when in the first position.

17. The bench seat assembly of claim 14, wherein: said seat units are pivotally mounted to said base units; and a seat locking assembly is attached to each said seat unit for selectively locking said seat unit in a selected orientation relative to said base unit.

18. The bench seat assembly of claim 14, wherein:

each said support arm includes a U-beam with a first end section disposed in said base unit that is rotatably mounted to said base unit, a main section that extends away from said base unit and a second end section that is parallel to said first end section, wherein said back section with which said support arm is associated is rotatably mounted to said second end section;

a support arm locking assembly is attached to said base unit to inhibit rotation of said U-beam first end section; and a back locking assembly is attached to said support arm to inhibit rotation of said back section around said U-beam second end section, wherein said back locking assembly is configured to lock said back section in the first position or in the second position.

19. The bench seat assembly of claim 18, wherein said back locking assembly is further configured to lock said back section in a third position in which said back section serves as a back support for said associated seat unit and said back section has an orientation opposite the orientation of said back section when in the first position.

* * * * *